US008056755B2

(12) United States Patent
Williams

(10) Patent No.: US 8,056,755 B2
(45) Date of Patent: Nov. 15, 2011

(54) SPILL-RESISTANT BEVERAGE CONTAINER

(76) Inventor: Margaret R. Williams, Rowlett, TX (US)

( * ) Notice: Subject to any disclaimer, the term of this patent is extended or adjusted under 35 U.S.C. 154(b) by 225 days.

(21) Appl. No.: 12/462,899

(22) Filed: Aug. 11, 2009

(65) Prior Publication Data

US 2010/0044385 A1 Feb. 25, 2010

Related U.S. Application Data

(60) Provisional application No. 61/189,846, filed on Aug. 22, 2008.

(51) Int. Cl.
*B65D 25/38* (2006.01)

(52) U.S. Cl. ..... 220/703; 220/710; 220/716; 220/731

(58) Field of Classification Search ..... 220/703, 220/716, 731, 709, 710, 705, 708, 707
See application file for complete search history.

(56) References Cited

U.S. PATENT DOCUMENTS

| | | | | |
|---|---|---|---|---|
| 2,143,027 | A * | 1/1939 | Perry | 215/374 |
| 4,437,576 | A * | 3/1984 | Barniak | 220/710 |
| 6,032,824 | A * | 3/2000 | Barrow | 220/621 |
| 6,375,092 | B1 * | 4/2002 | Banach | 239/33 |
| D547,120 | S * | 7/2007 | Brenner | D7/507 |

* cited by examiner

*Primary Examiner* — Stephen Castellano
(74) *Attorney, Agent, or Firm* — Steven W. Smith

(57) ABSTRACT

A spill-resistant beverage container having an inwardly projecting, annular contoured lip forming an aperture at the top of a beverage reservoir. The aperture is smaller than the diameter of the top rim of the reservoir. The contoured lip reduces spillage, especially when used with shallow containers such as a martini glass. A smaller aperture in the surface of the contoured lip enables beverage consumption, either directly by mouth or through a straw.

2 Claims, 1 Drawing Sheet

SPILL-RESISTANT BEVERAGE CONTAINER

RELATED APPLICATIONS

This application claims the benefit of U.S. Provisional Application No. 61/189,846 filed Aug. 22, 2008, the disclosure of which is incorporated herein by reference in its entirety.

TECHNICAL FIELD

The present invention is directed to beverage containers. More particularly, and not by way of limitation, the present invention is directed to a spill-resistant beverage container.

BACKGROUND

Conventional beverage containers may vary in shape and size, but typically are merely carriers for the beverages contained within. Through the years, specialty shaped glasses and cups have been developed for many types of beverages, particularly in relationship to cocktail beverages. For example, an inverted conically shaped vessel, which includes a long stem and a base, depicts what is traditionally known as a martini glass. Due to the cultural iconography of the martini glass, it continues to grow in popularity and is used for many other drinks such as Manhattans, gimlets, sidecars, and most recently the Cosmopolitan creating an insatiable demand for candy-colored martini spin-offs. The popularity of the aforementioned drinks has resulted in the increased use of these types of beverage containers even though they are an ineffective container for holding and drinking beverages without spillage. The broad diameter and shallow slope of the walls of the martini glass make it susceptible to spillage occurring during minimal movement.

SUMMARY

There remains a need for a spill-resistant beverage container that retains a stylish appearance while enabling easy access to the beverage and preventing spillage during movement or tilting of the container. The present invention provides such a spill-resistant beverage container.

In particular, there is a need for a spill-resistant beverage container with the basic and common properties of a martini-type glass, i.e., a shallow conically-shaped reservoir balanced on a stiletto-stem running between the base and the reservoir.

Embodiments of the present invention include a beverage reservoir, such as a glass or cup, with an inwardly projecting, annular contoured lip. A circular inner edge of the lip forms an aperture at the top of the reservoir, wherein the diameter of the aperture is less than the widest diameter of the reservoir. The inwardly projecting, annular contoured lip reduces spillage of a beverage from the reservoir when the container is moved or tilted by a user. A smaller aperture is formed in the contoured lip to provide access to the beverage within the reservoir either directly by tilting the glass or by inserting a straw.

In one embodiment, the present invention is directed to a spill-resistant beverage container for holding a liquid beverage. The container includes at least one side wall having an upper edge, the upper edge forming an outer rim of the container; and an annular contoured lip projecting inwardly from the outer rim. The annular contoured lip forms a partial upper surface of the container, wherein an inner edge of the annular contoured lip forms a first aperture in the upper surface of the container. When liquid is placed in the container, the annular contoured lip reduces spillage from the container as the container is moved or tilted by a user.

In another embodiment, the present invention is directed to a spill-resistant drinking glass for holding a liquid beverage. The drinking glass includes at least one side wall having an upper edge, the upper edge forming an outer rim of a liquid reservoir; and an annular contoured lip of uniform width projecting inwardly from the outer rim. The annular contoured lip forms a partial upper surface of the reservoir that reduces spillage of the liquid beverage from the reservoir when the drinking glass is moved or tilted by a user. An inner edge of the annular contoured lip forms a central aperture in the upper surface of the reservoir. The central aperture is large enough to be used to fill the container and to provide access for cleaning the interior of the container. The annular contoured lip includes a second aperture located between the inner edge of the annular contoured lip and the outer rim of the reservoir for drinking from the reservoir. The second aperture is smaller than the central aperture and is sized in a range of one-eighth to one-half inch to accept a drinking straw. The drinking glass also includes a horizontal base for supporting the reservoir, and a vertical stem connecting the base to the reservoir.

In a particular embodiment, the at least one side wall is a circular side wall that slopes upwardly and outwardly from a point of origin, thereby forming a conically shaped reservoir.

BRIEF DESCRIPTION OF THE DRAWINGS

For a more complete understanding of the present invention, and the advantages thereof, reference is now made to the following descriptions taken in conjunction with the accompanying drawings, wherein like numbers designate like objects, and in which.

DETAILED DESCRIPTION OF EMBODIMENTS

In the following description, terms such as inwardly, upward, circular, diameter, proportionately, and the like, are solely for the purpose of clarity in illustrating various embodiments, and should not be taken as words of limitation. The drawings are for the purpose of illustrating an exemplary embodiment of the present invention and are not intended to be dimensional or to scale.

The present invention provides a beverage container or glass having features to reduce spillage of the liquid beverage when the container or glass is moved. The container may be made from various materials such as glass, plastic, and the like. The present invention is particularly applicable to beverage containers having a shallow reservoir, which increases the likelihood that the liquid beverage within will be spilled during minimal movement. Examples of such shallow vessels include martini glasses, margarita glasses, and some types of champagne glasses.

Figure 1:
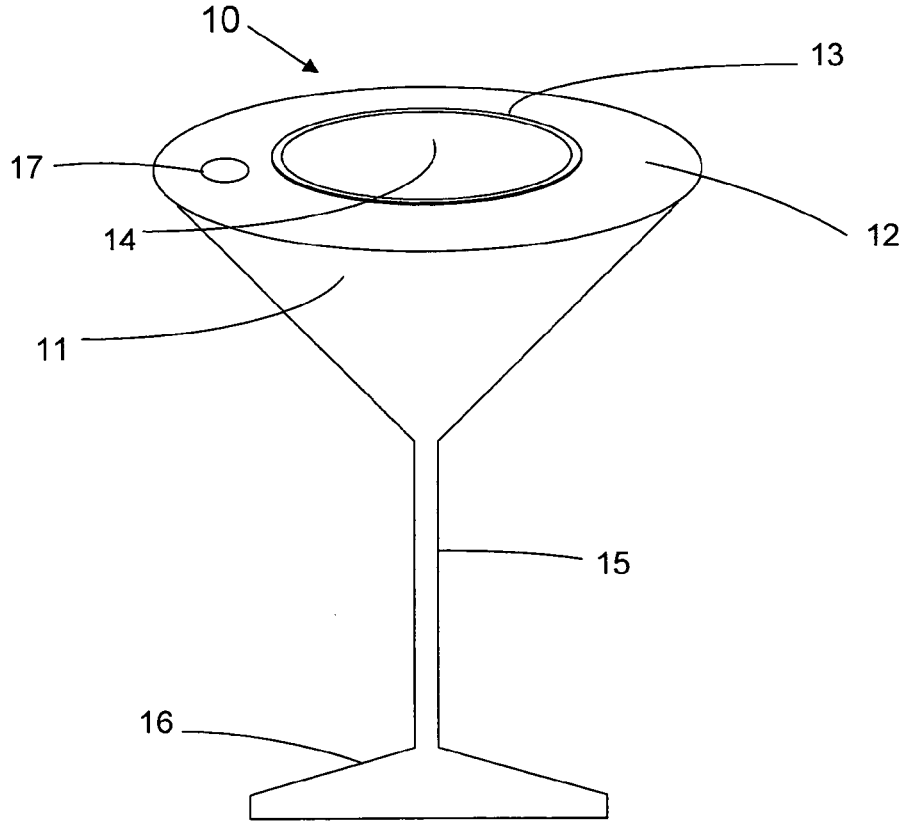
FIG. 1 is a perspective view of one embodiment of a beverage container according to the present invention.

FIG. 1 is a perspective view of one embodiment of a beverage container 10 according to the present invention. In this embodiment, the present invention is styled as a martini-type glass having a shallow liquid reservoir 11. According to the invention, the reservoir has an inwardly projecting, annular contoured lip 12 at the top of the reservoir. A circular inner edge 13 of the lip forms an aperture 14 at the top of the reservoir, wherein the diameter of the aperture is less than the widest diameter of the reservoir. The rimmed, inwardly projecting, contoured lip reduces spillage of a beverage from the reservoir when the container is moved. A smaller aperture 17 is formed on a top surface of the contoured lip 12 to provide access to the beverage within the reservoir either directly by tilting the glass or by inserting a straw.

A conventional stem 15 and base 16 support the reservoir. The base as shown is circular and is large enough to keep the container 10 upright when placed on a horizontal or nearly horizontal surface. In other embodiments, the base and the stem may be other shapes and other sizes. In the embodiment shown, the base is integral with the stem 15 that runs between the base and the liquid holding reservoir 11. The reservoir 11 may have many different shapes and sizes, but as shown is a conical shape that is common to martini glasses. The reservoir is relatively shallow, and its shallowly angled surfaces make it susceptible to spillage when the beverage container 10 is moved.

Figure 2:
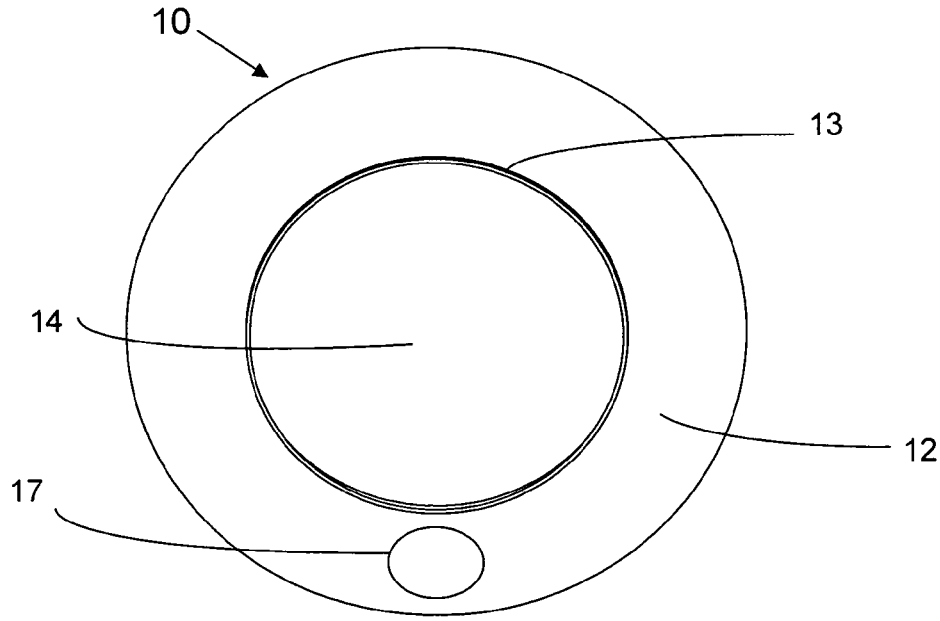
FIG. 2 is a top view of the beverage container of FIG. 1.

FIG. 2 is a top view of the beverage container of FIG. 1.

In one embodiment, the reservoir 11 is hand-blown glass. The reservoir and the contoured lip 12 are blown as a single piece, and then the aperture 14 is trimmed to form the lip. The contoured lip 12 is then pierced to form a smaller aperture 17, allowing for consumption of the beverage.

In another embodiment, the reservoir 11 and the contoured lip 12 are manufactured as two separate pieces, and are then joined together at the widest point of the reservoir. The pieces may be joined by heating them or with an adhesive.

It should be understood that the inwardly projecting contoured lip 12, while generally circular, may have many different curves or shapes according to the present invention to give a different visual appearance while still preventing portions of the beverage from spilling out of the reservoir 11. In elevation, the lip may also be of varying shapes. For example, the lip may be planar and horizontal; may be straight between the outer rim and the central aperture 14 but sloped upward toward the center; or may be curved in a convex curve between the outer rim and the central aperture (for example, a parabolic curve) to provide a smooth transition from the sides of the reservoir to the central aperture.

Additionally, although the central aperture 14 illustrated in FIGS. 1 and 2 is circular, the inner edge 13 of the contoured lip may have many different shapes or curves according to the present invention to provide a uniquely shaped aperture 14 and give a different visual appearance.

Likewise, the smaller aperture 17, as shown in the illustration and used for beverage consumption may vary in size and have many different shapes or curves while still allowing the beverage to be consumed from a straw or the user's lips. In one embodiment, the smaller aperture is circular and is sized in a range of one-eighth to one-half inch to accept a drinking straw.

Preferably, the inner edge 13 of the contoured lip is sized so that sufficient room is provided to allow for filling the reservoir 11 and cleaning the inside of the reservoir.

In an alternative embodiment, the contoured lip 12 may be removable to facilitate cleaning the inside of the reservoir 11. In this embodiment, the contoured lip may be attached, for example, with a temporary adhesive, screw threads, or other water-tight locking mechanism.

It is thus believed that the operation and construction of the present invention will be apparent from the foregoing description. While the system and apparatus shown and described has been characterized as being preferred, it will be readily apparent that various changes and modifications could be made therein without departing from the scope of the invention as defined in the following claims.

What is claimed is:

1. A spill-resistant drinking glass for holding a liquid beverage, comprising:

at least one side wall having an upper edge, the upper edge forming an outer rim of a liquid reservoir;

an annular contoured lip of uniform width projecting inwardly from the outer rim, said annular contoured lip forming a partial upper surface of the reservoir that reduces spillage of the liquid beverage from the reservoir when the drinking glass is moved or tilted by a user;

wherein an inner edge of the annular contoured lip forms a central aperture in the upper surface of the reservoir, said central aperture being large enough to be used to fill the container and to provide access for cleaning the interior of the container; and wherein the annular contoured lip includes a second aperture located between the inner edge of the annular contoured lip and the outer rim of the reservoir for drinking from the reservoir, said second aperture being smaller than the central aperture and sized in a range of one-eighth to one-half inch to accept a drinking straw;

a horizontal base for supporting the reservoir; and a vertical stem connecting the base to the reservoir.

2. The spill-resistant drinking glass according to claim 1, wherein the at least one side wall is a circular side wall that slopes upwardly and outwardly from a point of origin, thereby forming a conically shaped reservoir.

* * * * *